US007070460B1

(12) United States Patent
Nagano

(10) Patent No.: US 7,070,460 B1
(45) Date of Patent: Jul. 4, 2006

(54) POWER CORD AND ITS MANUFACTURING METHOD

(75) Inventor: Takahiko Nagano, Kashiwara (JP)

(73) Assignee: Fuji Electric Wire Industries Co., Ltd., Osaka (JP)

( * ) Notice: Subject to any disclaimer, the term of this patent is extended or adjusted under 35 U.S.C. 154(b) by 0 days.

(21) Appl. No.: 11/128,337

(22) Filed: May 13, 2005

(51) Int. Cl.
*H01R 13/405* (2006.01)

(52) U.S. Cl. ..... 439/736

(58) Field of Classification Search ..... 439/736, 439/92, 694, 690, 463, 622, 695, 606
See application file for complete search history.

(56) References Cited

U.S. PATENT DOCUMENTS 5,186,650 A * 2/1993 Hwang ..... 439/463
5,863,364 A * 1/1999 Lin et al. ..... 156/73.1
6,910,920 B1 * 6/2005 Su ..... 439/606

FOREIGN PATENT DOCUMENTS

JP 2001-167838 6/2001

OTHER PUBLICATIONS

English Language Abstract of JP 2001-167838.

* cited by examiner

*Primary Examiner*—J. F. Duverne
(74) *Attorney, Agent, or Firm*—Greenblum & Bernstein, P.L.C.

(57) ABSTRACT

The invention relates to a power cord having an insertion plug at one end of a cord, and its manufacturing method, more particularly to a power cord and its manufacturing method high in reliability in tracking resistance, free from deviation of blade interval in forming process or plugging and unplugging operation, and excellent in heat resistance and tracking resistance: more specifically, the power cord is composed by connecting blades to plural conductors exposed at the end of cord, holding these blades at a specified interval spacing, and covering the base side and leading end side of cord with synthetic resin to form a plug, characterized by inserting the base of blades or from the base to the leading end of cord at a specified spacing distance, and ejecting and forming a core by hard thermoplastic resin such as polyamide, polybutadiene, or polypropylene, and inserting the core, and ejecting and forming a plug by a soft thermoplastic resin.

13 Claims, 9 Drawing Sheets

POWER CORD AND ITS MANUFACTURING METHOD

BACKGROUND OF THE INVENTION

1. Field of the Invention

The present invention relates to a power cord having an insertion plug at one end of a cord, and its manufacturing method.

2. Description of the Prior Art

In a conventional power cord, for example, blades are connected to a plurality of conductors projected (exposed) from the leading end of cord, and the base side of blades and leading end side of cord are covered with vinyl chloride, and a plug is formed.

In this case of plug formed by vinyl chloride alone, it is excellent in forming performance and is inexpensive, but when the plug of vinyl chloride is inserted in the socket and left over for a long period, dust or moisture sticks to blades, and weak current begins to flow, and the resin texture is broken and a carbide conductive path may be formed to short-circuit blades, finally leading to outbreak of fire, and hence it had a problem of low reliability in tracking resistance.

Besides, since the plug is formed in one forming process (single forming process), shrinkage is likely to occur in thick wall portions, and the blade interval may be deviated by shrinkage.

Further, when the plug is formed of vinyl chloride, since vinyl chloride is relatively soft, it is likely to deform when inserting into or pulling out from the socket, and the blade interval may be deviated during such handling.

SUMMARY OF THE INVENTION

It is hence a primary object of the invention to insert the base of blades or from the base to the leading end of cord, eject and form a core by hard thermoplastic resin such as polyamide, polybutadiene, or polypropylene, insert the core, and eject and form a plug by a soft thermoplastic resin. As a result, the hard resin for composing the core is excellent in heat resistance, internal deterioration by heat is slight, and tracking fire can be prevented, thereby presenting a power cord free from deviation of blade interval, and capable of preventing deformation or deviation during plugging and unplugging operation.

It is other object of the invention to present a power cord in which the core is positioned at the front side of the plug, and the front of the core is exposed to the front of the plug, and therefore the plug front part can be formed of synthetic resin of strong tracking resistance such as polyamide, polybutadiene, or polypropylene, and if dust or moisture sticks to the blades at the front of the plug and weak current begins to flow, it is effective to prevent breakage of resin texture or formation of carbide conductive path due to weak current, so that strong reliability in tracking resistance is assured.

It is a different object of the invention to present a power cord having a locking structure of preventing separation of the two by integral forming (integration) of plug between the core and plug, in which the locking structure prevents gap forming or separation between the core and plug if the plug is handled roughly on the socket.

It is a different object of the invention to present a power cord in which the core has a front part positioned at the front side of the plug, and covering parts successively from the front part in the number corresponding to the number of conductors covering the base of the blades or from the base to the leading end of cord, and a linkage plate is provided in a specified thickness for mutually coupling plural covering parts in a specified length range from right after the front part, thereby preventing shrinkage of core and plug (see outer skin) and holding blades at specified interval.

It is a different object of the invention to present a manufacturing method in plural steps including a core forming process of ejecting and forming a core by hard thermoplastic resin such as polyamide, polybutadiene, or polypropylene, by inserting the base of blades, or from the base to the leading end of cord, and a plug forming process of ejecting and forming a plug by soft thermoplastic resin by inserting the core. As a result, since the resin for forming the core is hard, it is easy to hold the core, and it is possible to form without deviating the blade configuration. Since the core is covered with outer skin of plug, the plug is formed at least in two steps, and partial thickening is avoided, and it prevents inconvenience of deviation of blade interval due to shrinkage after forming. Further, since the wall thickness of the plug is thin, cooling time in the molding die in each forming process can be shortened, and the forming cycle time is shorter, and an economical manufacturing method of power cord is presented.

It is a different object of the invention to present a manufacturing method of power cord, capable of holding blade interval at a specified interval by positioning the core at the front side of the plug and exposing the front side of the core to the front side of the plug in the plug forming process, thereby allowing the front side of the core to contact with the forming die, and forming the plug in a state of securely holding it.

It is a different object of the invention to present a manufacturing method of power cord capable of bonding the both securely and firmly by forming a locking structure for preventing separation of the two by integrally forming the plug, between the core and plug, in the plug forming process.

It is a different object of the invention to present a manufacturing method of power cord effective for preventing occurrence of shrinkage and shortening the forming cycle time, by forming the core so as to be positioned in the thick wall portion of the front side of the plug in the plug forming process.

It is a different object of the invention to present a manufacturing method of power cord, in which the molding die used in ejection forming has the plug divided in two halves, and the die split surface is formed at a position not separating from the blades, and thereby positioning of blades is excellent, and processing and positioning of die are also easy.

Other objects of the invention will be clarified from the following description of the embodiments.

DESCRIPTION OF THE PREFERRED EMBODIMENT

Figure 1:
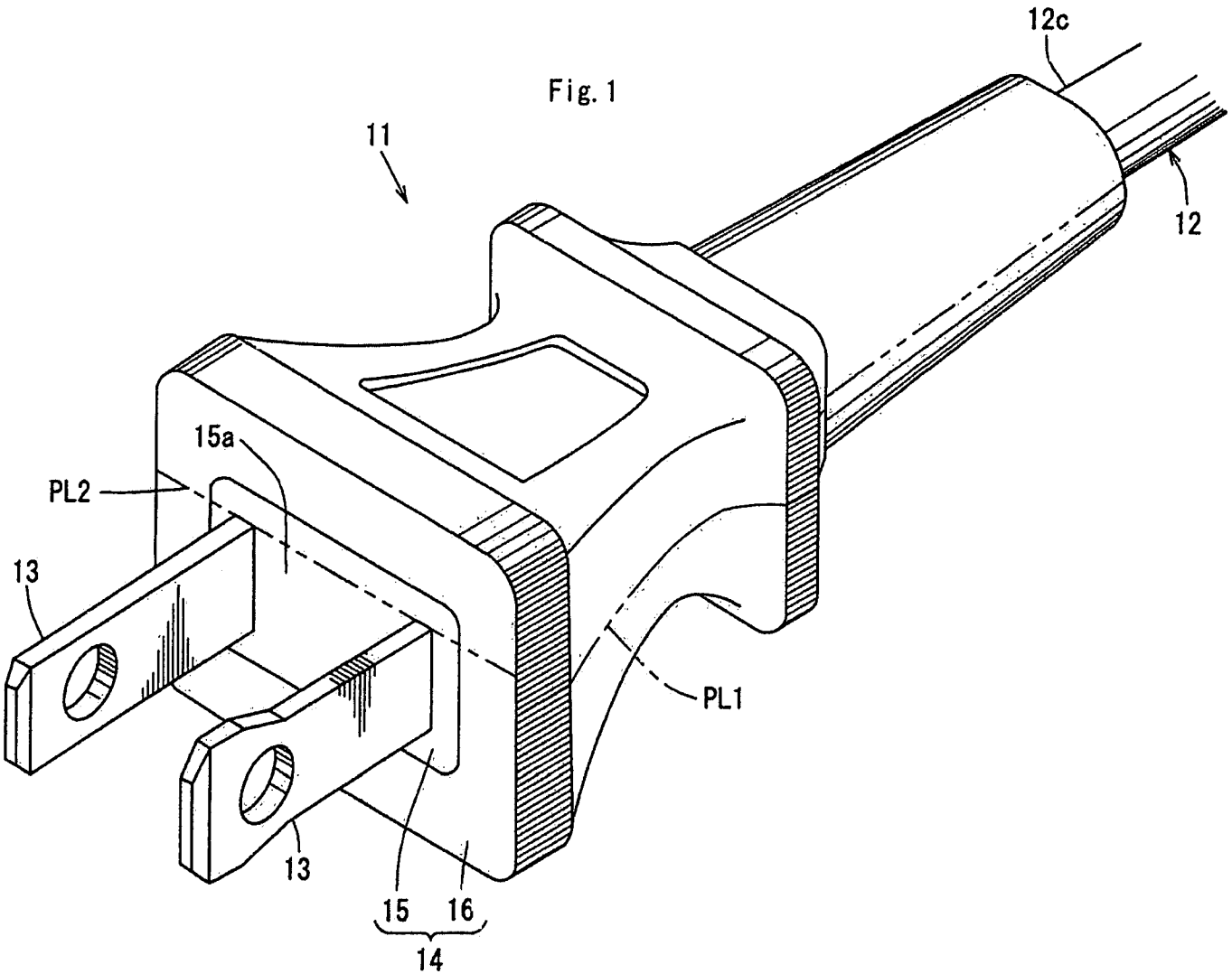
FIG. 1 is an outline perspective view of power cord of the invention.

An embodiment of the invention is described below while referring to the drawing.

FIG. 1 is a perspective view of power cord 11, in which the power cord 11 has blades 13, 13 connected to leading ends of a cord 12 projected from a plug 14. The plug 14 is formed in two steps as described below. This embodiment shows the power cord 11 having two blades 13, 13, but the embodiment may be also applied in a type used in three-phase alternating-current power source or the like.

Figure 2:
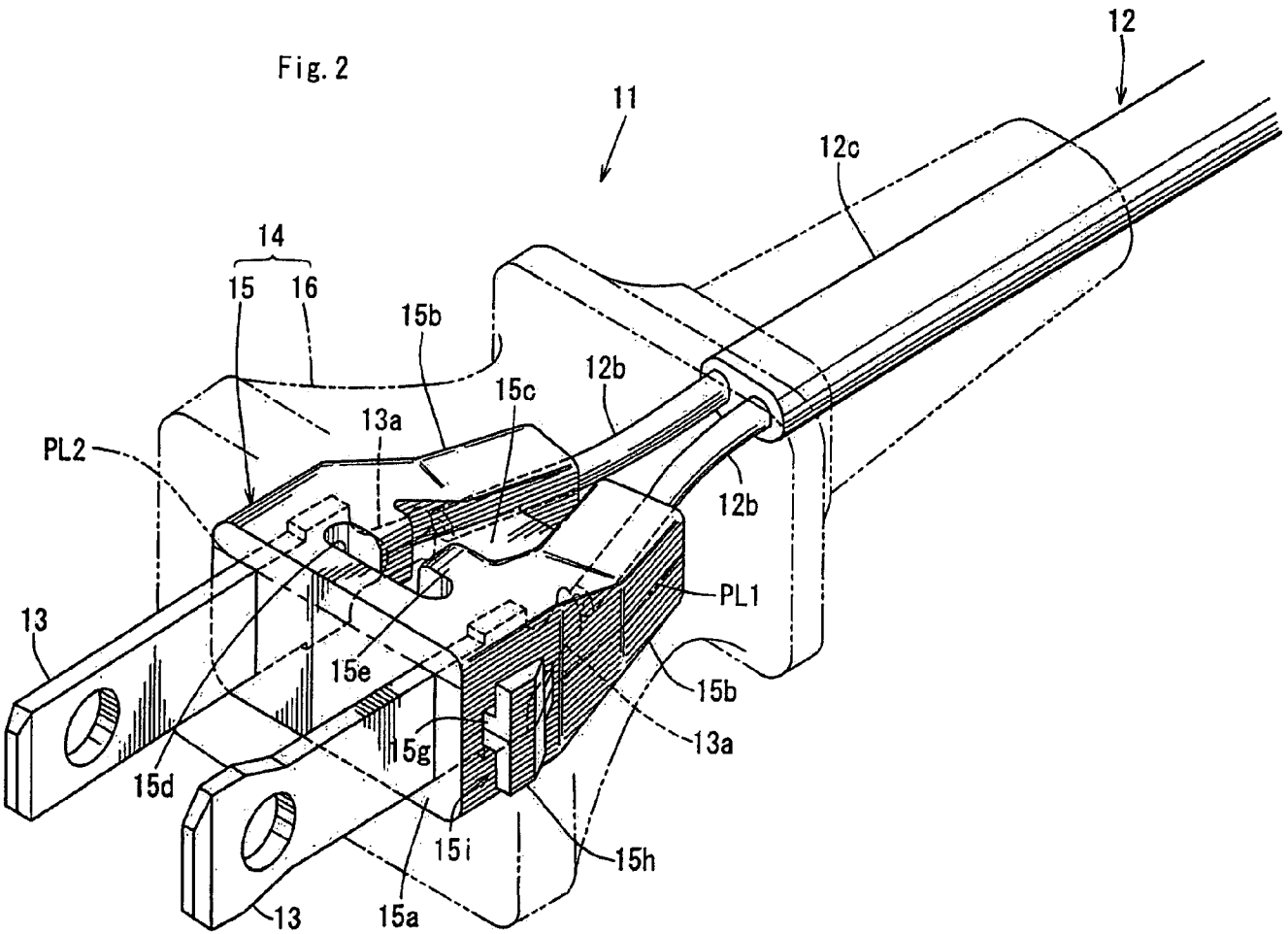
FIG. 2 is a perspective view showing essential parts of power cord.
Figure 3:
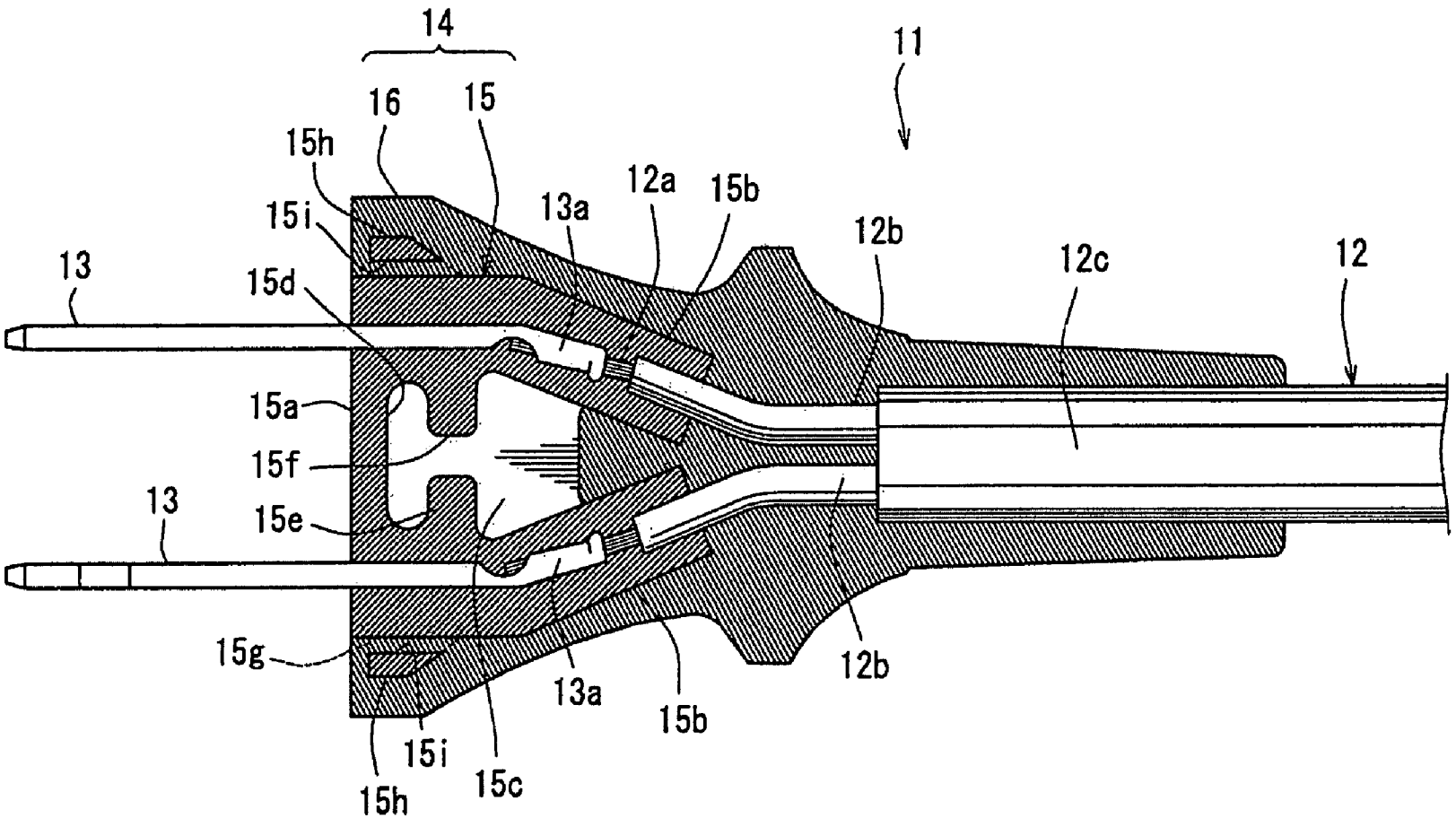
FIG. 3 is a cross sectional view of power cord.

The cord 12 is formed as shown in FIG. 2 and FIG. 3, in which the outer circumference of a plurality of conductors 12*a*, 12*a* (see FIG. 3) is covered with insulator 12*b* and sheath 12*c*, that is, rubber material such as chloroprene rubber, EP rubber, chlorosulfonated polyethylene rubber, or proper vinyl material.

The leading end of the cord 12 has a bifurcate insulator 12*b* corresponding to the sheath 12*c*, and the conductor 12*a* is exposed from the insulator 12*b*, and the conductors 12*a*, 12*a* are crimped to the base 13*a* of a pair of blades 13 and connected integrally.

The pair of blades 13 and leading end of cord 12 are inserted and formed in a core 15 (inner plug) at specified spacing configuration. At this time, to compose a structure as shown in FIG. 3, the integrated core 15 and blades 13, 13 are inserted and outer skin 16 (outer plug) is formed, and the plug 14 is formed.

Figure 4:
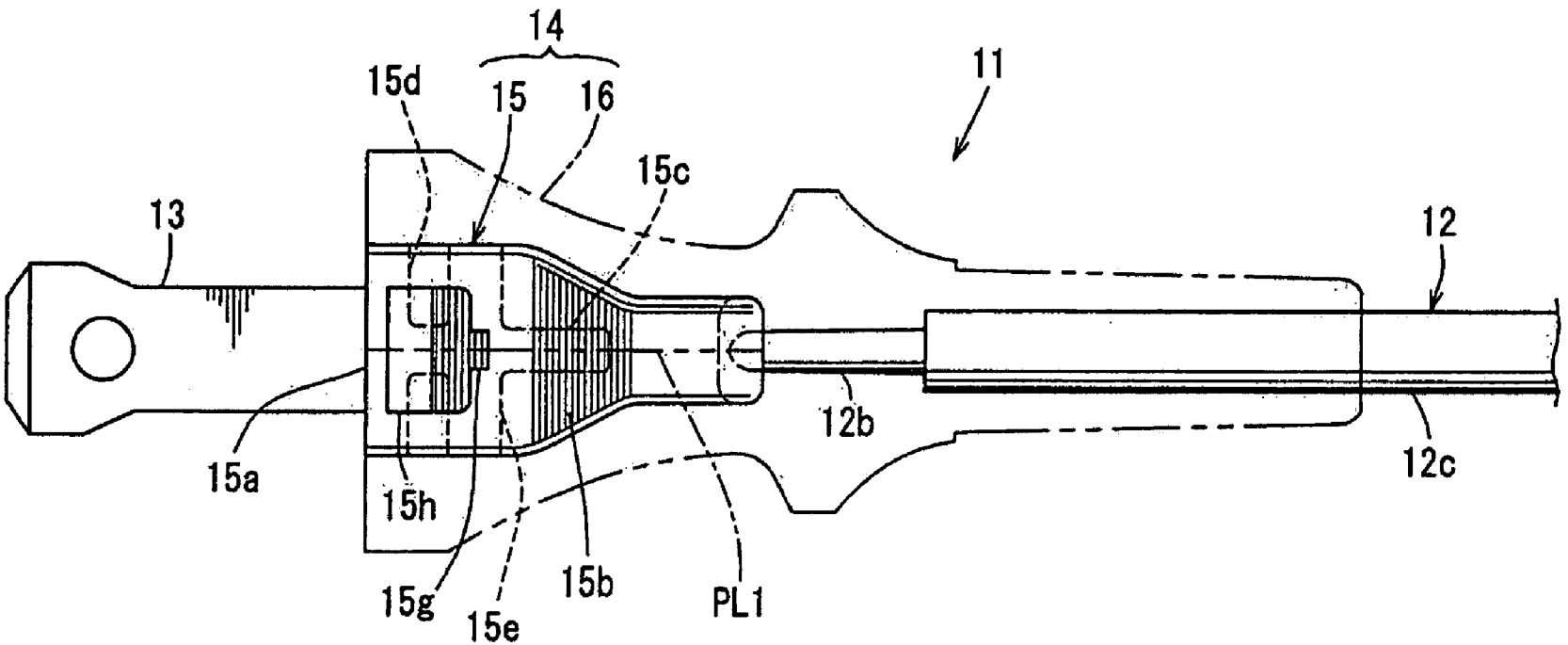
FIG. 4 is a side view of power cord.
Figure 5:
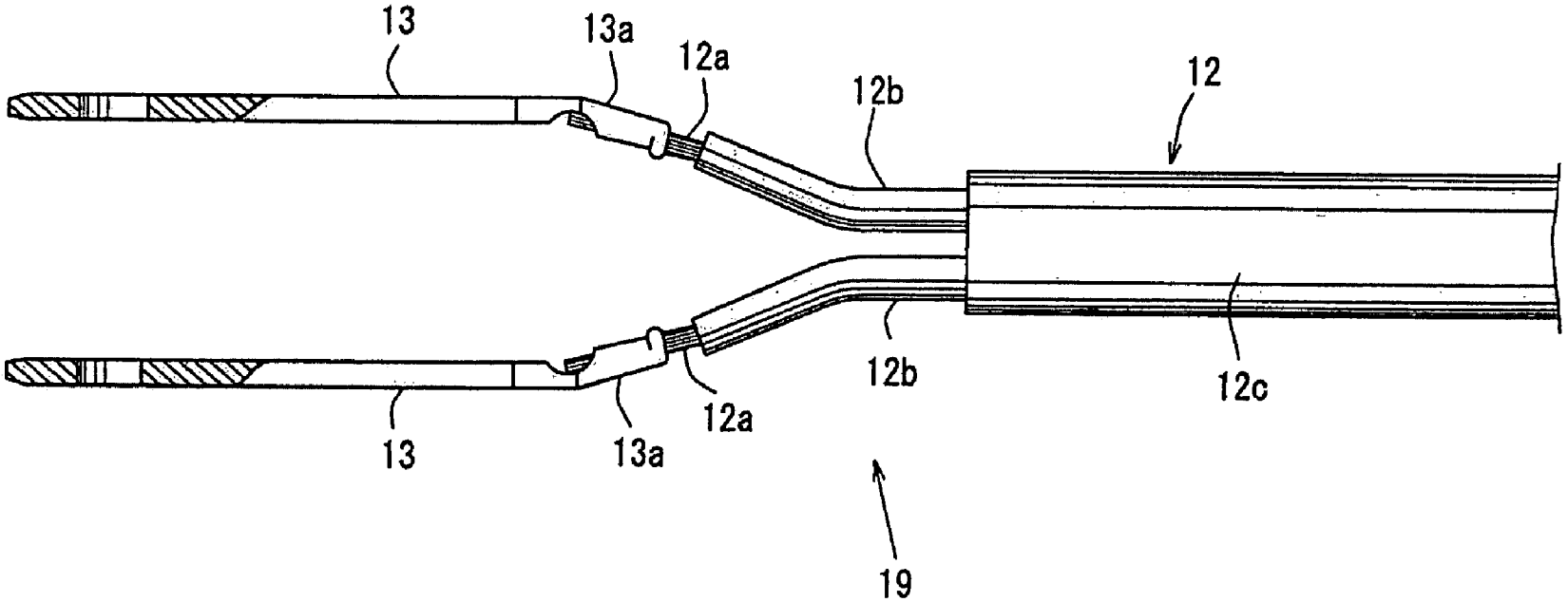
FIG. 5 is a plan view before core forming process.
Figure 6:
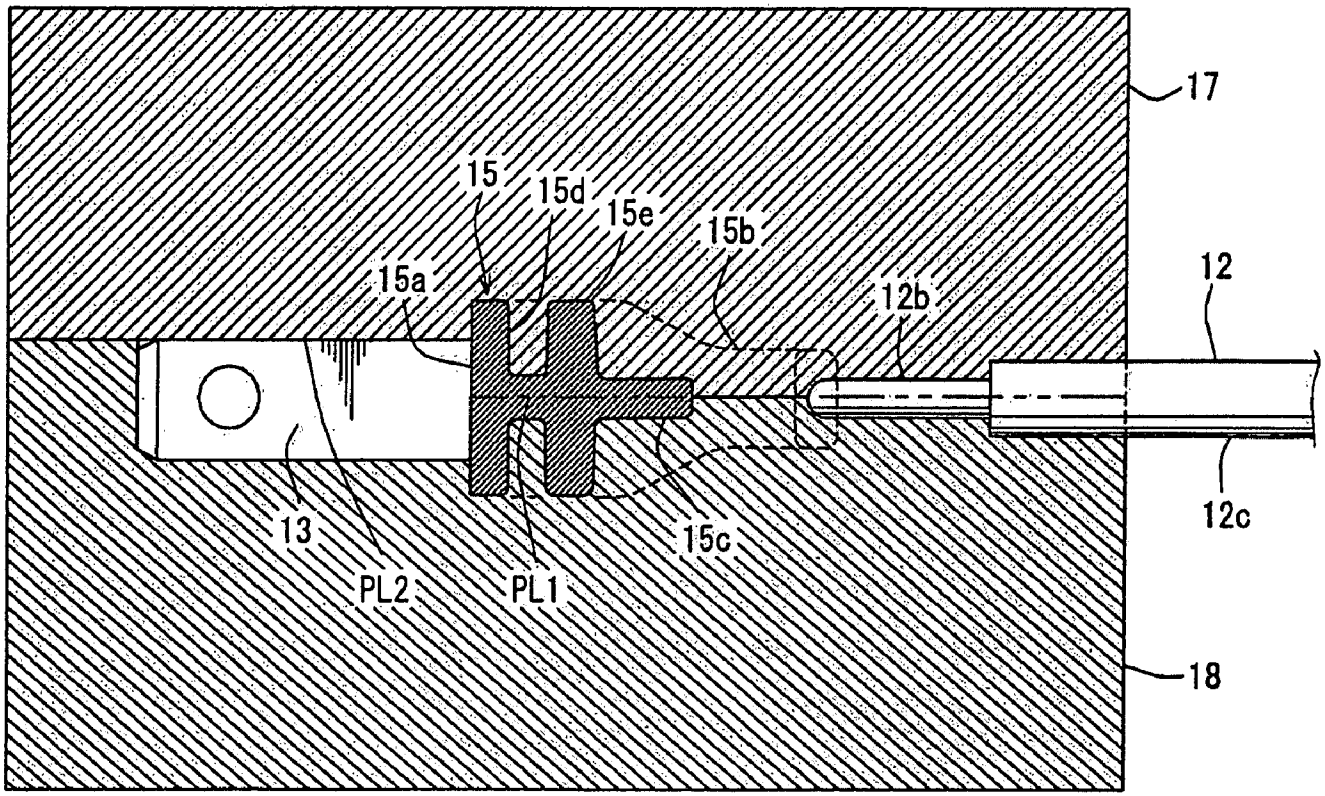
FIG. 6 is an explanatory diagram of core forming process.

More specifically, in order to obtain the core 15 inserting the blades 13 and leading end of cord 12 as shown in FIG. 4, an assembly 19 connecting the leading end of conductor 12*a* of cord 12 to the base 13*a* of blades 13 as shown in FIG. 5 is held between upper pattern 17 and lower pattern 18 as shown in FIG. 6, with blades 13, 13 spaced at specified interval, and is ejected and formed by hard resin in this state while holding the blades 13, 13 and cord 12. As synthetic resin, polyamide (polyamide 66, polyamide 46, polyamide 6, etc.), polybutadiene, polypropylene, or other thermoplastic resins are used. These resins are hard and excellent in heat resistance.

The core 15 is positioned in thick wall portion at the front side of the plug 14. In this embodiment, the front part 15*a* of the core 15 is formed on the front side of the plug 14 so as to be exposed in flush or nearly flush state. The front part 15*a* of the core 15 may not be exposed, but when exposed, a higher safety is obtained when using a synthetic resin not so high in electric insulation as the material for the outer skin 6.

The core 15 (inner plug) comprises, as shown in FIG. 2, FIG. 3, FIG. 4, FIG. 6, and FIG. 7, a cubic front part 15*a* positioned at the front side of outer skin 16 (outer plug) of plug 14, covering parts 15*b*, 15*b* in a number corresponding to the number of conductors (two in this case) covering successively from the front part 15*a* consecutively from front part of the base 13*a* of blade 13 to the bifurcate leading end of insulator 12*b* in the cord 12, and bent in the rear end side in converging direction, a flat coupling part 15*c* of uniform thickness coupling between the pair of right and left covering parts 15*b*, 15*b* in a specified length range (in this case, the range up to the position near the rear end of blade 13) from right after the front part 15*a* in the middle of the vertical direction of the covering part 15*b*, a recess 15*d* and a bump 15*e* formed right after the front part 15*a* at the upper and lower sides of the coupling part 15*c*, a notch 15*f* formed in the middle of the lateral direction of the bump 15*e*, and a protruding locking part 15*h* provided by way of a support post 15*g* from both right and left sides (right and left walls) of the core 15 integrating the front part 15*a* and a pair of covering parts 15*b*, 15*b*.

Herein, the size of the front part 15*a* in the surface direction is specified, that is, the dimension in the vertical direction is set larger than the vertical width of blade 13, the dimension in the lateral direction is set longer than the lateral spacing distance of the pair of blades 13, 13, and the area is determined so as to surround and hold completely the two separate blades 13, 13.

The thickness of flat coupling part 15*c* of uniform thickness is set at ¼ to ⅕ of vertical dimension of the front part 15*a*, so that the thickness of the outer skin 16 to be formed later may be reduced.

The upper and lower sides of the bump 15*e* formed at both upper and lower sides of the coupling part 15*c* are set to be flush with the upper and lower sides of the front part 15*a*.

In addition, the vertical dimension of the locking part 15*h* is set smaller than the vertical dimension of the front part 15*a*, and the vertical dimension of the support post 15*g* is set at ½ to ⅓ of the vertical dimension of the locking part 15*h*, and a recess 15*i* in through shape allowing to flow fused resin in plug forming process (see FIG. 8) explained later is formed at both upper and lower part of the support post 15*g*.

On the other hand, die parting lines PL1, PL2 from the upper pattern 17 and lower pattern 18 as the forming die shown in FIG. 6 are formed at positions for dividing the core 15 into upper and lower halves in a side view, and not dividing the pair of blades 13, 13.

For the convenience of drawing, same reference numerals as parting lines PL1, PL2 are given to the power cord 11, and as shown in FIG. 6 and FIG. 2, one parting line PL1 is formed at a position for dividing the front part 15*a*, support post 15*g*, locking part 15*h*, and covering part 15*b* of the core 15 into upper and lower halves in a side view, while other parting line PL2 does not divide the pair of blades 13, 13, but extends in the lateral direction at the front side of the front part 15*a* corresponding to the upper end position of the pair of blades 13, 13, and is formed at a position for dividing the front part 15*a* into upper and lower halves not equally. Herein, the front end of the parting line PL1 and other end of other parting line PL2 are coupled in the vertical direction at the parting line not shown.

By forming parting lines PL1, PL2 of such structure, in the core forming process (see FIG. 6), on the surface in the shape of opened lower pattern 18, the assembly 19 connecting the leading end of the conductor 12*a* of the cord 12 to the base 13*a* of the blade 13 shown in FIG. 5 may be set in place, and positioning of the assembly 19, in particular, the blade 13 is excellent, and positioning of die is also achieved when processing and forming the die (upper pattern 17, lower pattern 18).

Figure 7:
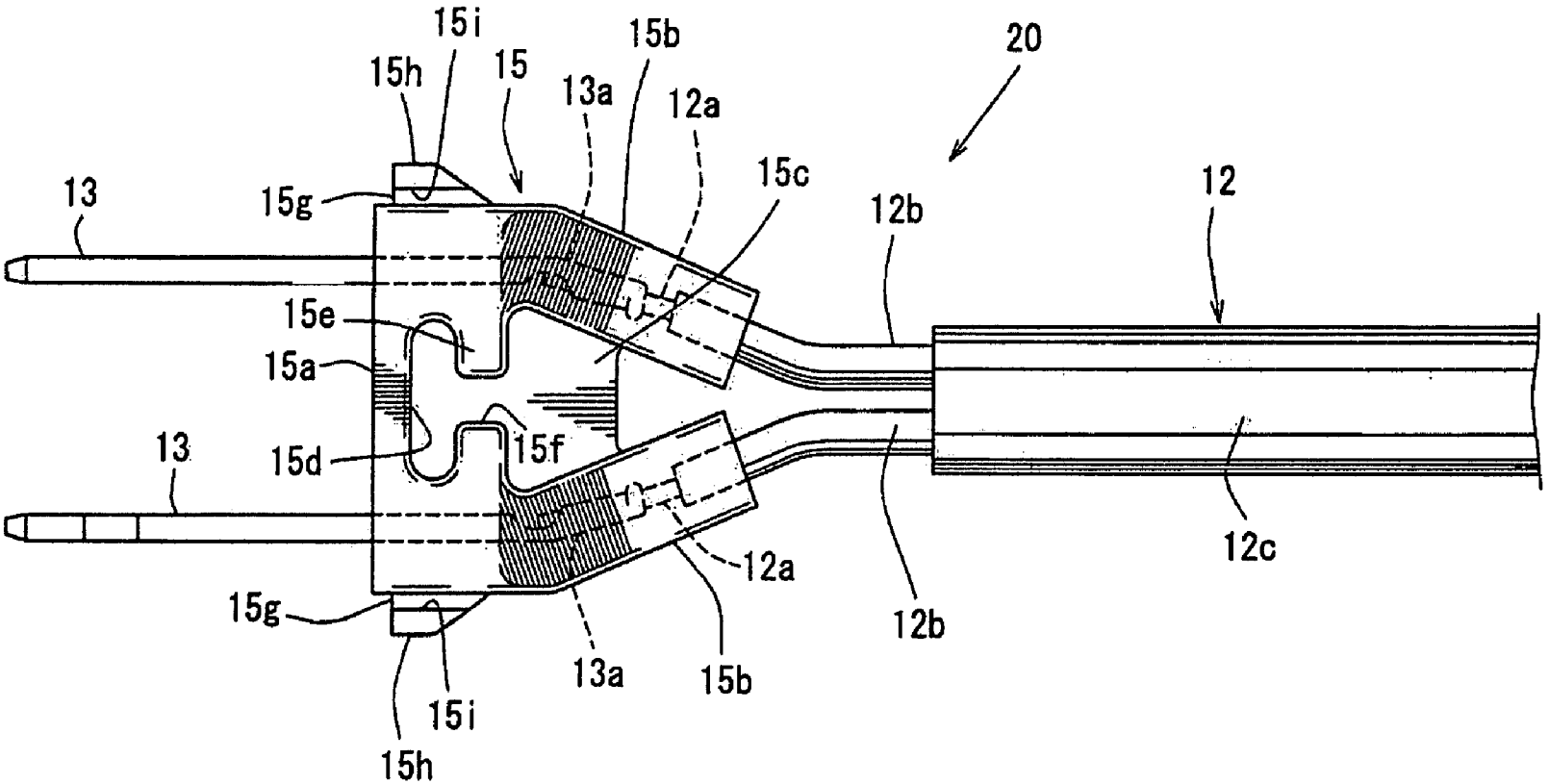
FIG. 7 is a plan view after core forming process.

After setting the assembly 19 shown in FIG. 5 on the die (upper pattern 17, lower pattern 18) as shown in FIG. 6, the core 15 is ejected and formed by the hard thermoplastic resin described above (core forming process), and a pre-formed piece (lower formed piece) 20 shown in plan view in FIG. 7 is obtained.

Figure 8:
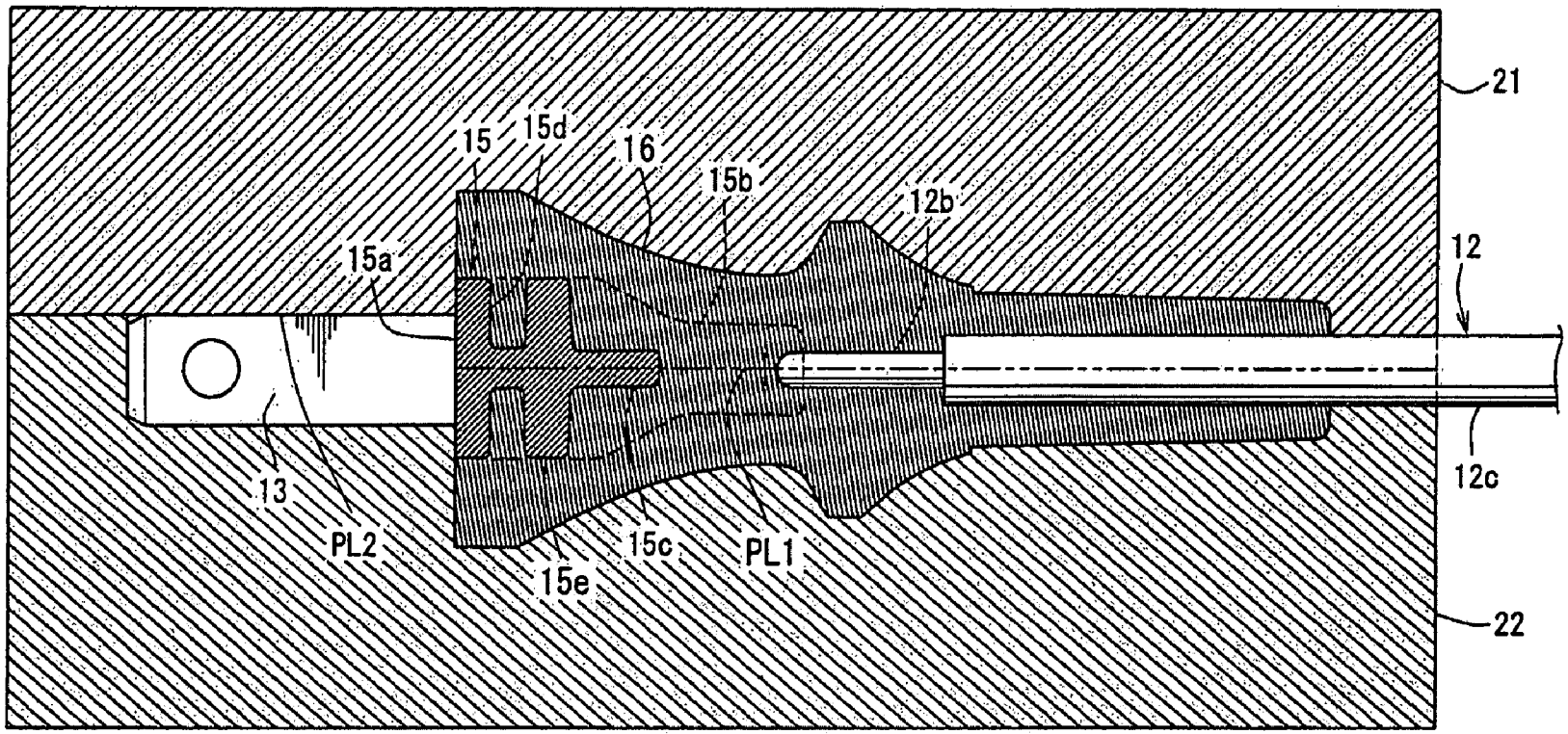
FIG. 8 is an explanatory diagram of plug forming process.

Using other dies 21, 22 shown in FIG. 8, the outer skin 16 of the plug 14 is ejected and formed (plug forming process), and in this plug forming process, too, parting lines PL1, PL2 of the dies 21, 22 are formed same as the parting lines shown in FIG. 6. For the convenience of explanation, same reference numerals are given in the parting lines in FIG. 6 and parting lines in FIG. 8.

That is, as shown in FIG. 1, one parting line PL1 is formed at a position for dividing the outer skin 16 into upper and lower halves in a side view, while other parting line PL2 does not divide the pair of blades 13, 13, but extends in the lateral direction at the front part 15*a* of the core 15 and the front part of the outer skin 16 corresponding to the upper end position of the pair of blades 13, 13, and is formed at a position for dividing each front part into upper and lower halves not equally. Herein, the front end of the parting line PL1 and end of other parting line PL2 are coupled in the vertical direction at the parting line not shown same as in FIG. 6.

Figure 9:
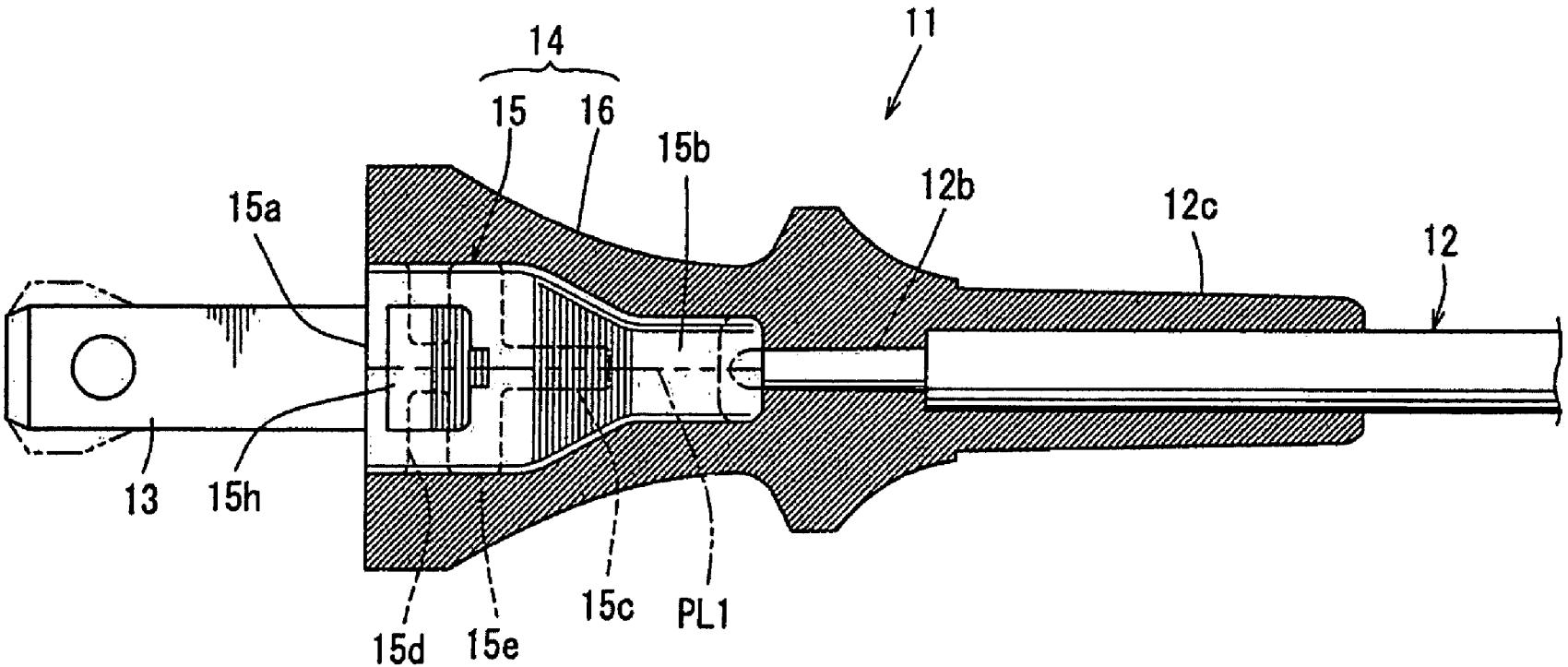
FIG. 9 is a side view of power cord after plug forming process.

When forming the outer skin 16, the core 15 (pre-formed piece 20 in FIG. 7) having the cord 12 and blade 13 integrated by insert forming is put between the upper pattern 21 and lower pattern 22 having a cavity of specified shape as shown in FIG. 8, and is ejected and formed by synthetic resin (plug forming process). By this forming, as shown in FIG. 9, a power cord 11 including the plug 14 is completed. As the resin material, vinyl chloride generally used in socket plug is used, but thermoplastic resin same as core 5 may be also used.

By this plug forming process, as shown in FIG. 3, FIG. 8, and FIG. 9, the ejected fused resin flows into the recess 15*d* of the core 15, and is linked vertically to be an integral body as shown in the diagram.

Accordingly, separation of core 15 and outer skin 16 can be securely prevented. That is, the recess 15*d* and bump 15*e* form a locking structure.

Fused resin also flows into the recess 15*i* of through shape in the locking part 15*h* of the core 15, and locking action is obtained. The locking part 15*h* and through-shape recess 15*i* form a locking structure.

Thus, according to the power cord of the embodiment, by inserting the base 13*a* of the blade 13 spaced at a specified distance, or from the base 13*a* to the leading end of the cord 12 (leading end of insulator 12*b*), the core 15 is ejected and formed by hard thermoplastic resin such as polyamide, polybutadiene, or polypropylene, and by inserting the core 15, the plug 14 is ejected and formed by soft thermoplastic resin, and the hard resin for forming the core 15 is excellent in heat resistance, and internal deterioration by heat is slight, and tracking fire can be prevented, and without deviating the space interval of the blades 13, a plurality of blades 13, 13 can be held appropriately, and deformation or deviation of blade interval can be prevented in repeated plugging and unplugging operations on the socket.

By positioning the core 15 at the front side of the plug 14, and forming the front part 15*a* of the core 15 so as to be exposed on the front side of the plug 14 (in this case, the front part 15*a* to be flush with the front side of the plug 14), the plug front part is formed of a resin strong in tracking resistance such as polyamide, polybutadiene, or polypropylene, and if dust or moisture sticks to blades 13, 13 at the front side of the plug 14, and weak current begins to flow, it is effective to prevent breakage of resin texture by weak current or formation of carbide conductive path, and tracking fire is not caused by these reasons, so that a high reliability in tracking resistance is assured.

Further, between the core 15 and plug 14, a locking structure (recess 15*d*, bump 15*e*, and/or locking part 15*h*, recess 15*i*) is formed for preventing separation of the two (core 15 and outer skin 16) by integrally forming (integrating) the plug 14, and by this locking structure, if the plug 14 is handled roughly on the socket, gap or separation between the core 15 and plug 14 (in particular, outer skin 16) can be prevented.

In addition, the core 15 comprises the front part 15*a* positioned at the front side of the plug 14, and covering parts 15*b*, 15*b* in the number corresponding to the number of conductors successively from the front part 15*a* and covering the base 13*a* of the blade 13 or from the base 13*a* to the leading end of the cord 12 (leading end of insulator 12*b*), and a flat coupling part 15*c* of uniform thickness is provided to couple mutually between the plural covering parts 15*b*, 15*b* in a specified length range from right after the front part 15*a*, and therefore shrinkage of core 15 and plug 14 (outer skin 16) is prevented, and blades 13, 13 can be held at a specified interval.

That is, shrinkage is caused by volume contraction when fused resin is cooled and solidified, and it is likely to occur in thick portions, but by thinly forming the thick portions of the outer skin 16 by the coupling part 15*c*, shrinkage is prevented from occurring in the outer skin 16. Besides, in a uniform thickness, a flat coupling part 15*c* is provided between the pair of covering parts 15*b*, 15*b*, and hence shrinkage is prevented from occurring in the core 15.

Although the leading end of the blades 13, 13 are opened and deformed by shrinkage, since occurrence of shrinkage is prevented, blades 13, 13 can be maintained at a specified interval.

Further, this coupling part 15*c* acts as rib after cooling and solidification of the resin, deformation by external force of covering parts 15*b*, 15*b* can be also prevented, and it also prevents the leading end of blade 13 from opening and deforming by external force of plug operation.

On the other hand, according to the manufacturing method of the power cord 11 of the embodiment, the power cord 11 is manufactured in plural steps including a core forming process (see FIG. 6) of ejecting and forming a core 15 by hard thermoplastic resin such as polyamide, polybutadiene, or polypropylene, by inserting the base 13*a* of blade 13, or from the base 13*a* to the leading end of cord 12 (leading end of insulator 12), in a state being spaced by a specified distance, and a plug forming process (see FIG. 8) of ejecting and forming a plug 14 by soft thermoplastic resin by inserting the core 15 (specifically pre-formed piece 20 shown in FIG. 20).

Since the resin for forming the core 15 is hard, it is easy to hold the blade without deviating the spacing configuration of blade 13, and in the next plug forming process (see FIG. 8), it is easy to hold the core 15, and it is possible to form without deviating the configuration of blades 13, and the core 15 is covered with outer skin 16 of plug 14, the plug 14 is formed at least in two steps, and it prevents inconvenience of deviation of interval of blades 13 due to shrinkage after forming, and further, since the wall thickness of the plug 14 is thin, cooling time in the die (upper pattern 17, 21, lower pattern 18, 22) in each forming process can be shortened, and the forming cycle time is shorter, and it is economical.

In the plug forming process (see FIG. 8), by positioning the core 15 at the front side of the plug 14 and exposing the front part 15*a* of the core 15 to the front side of the plug 14, the front 15*a* of the core 15 contacts with the die, and the plug 14 can be formed in a state of securely holding it, so that the blades 13 can be held at a specified interval.

Also in the plug forming process (FIG. 8), by forming a locking structure (see at least one of recess 15*d*, bump 15*e*, locking part 15*h*, and recess 15*i*) for preventing separation of the two (core 15 and outer skin 16) by integrally forming the plug 14, between the core 15 and plug 14, the both (in particular, core 15 and outer skin 16) can be coupled securely and firmly.

In addition, in the plug forming process (FIG. 8), since the core 15 is positioned in the thick wall portion at the front side of the plug 14, it is effective for preventing occurrence of shrinkage and shortening the forming cycle time.

Further, the die (upper pattern 17, 21, lower pattern 18, 22) used in ejecting and forming process divides the plug 14 into two halves, and parting lines PL1, PL2 are formed at positions not dividing the blades 13, and thereby positioning of blades 13 is excellent, and processing and positioning of upper and lower die patterns are also easy.

The invention claimed is:

1. A power cord, comprising:

connecting blades connected to plural conductors having an insulator positioned at a leading end of the power cord, wherein the connecting blades are held at a specified interval spacing, and a base side of the blades and a leading end side of the power cord are covered with a synthetic resin to form a plug; and the plug having a core that includes covering parts corresponding to the number of plural conductors, wherein the covering parts cover the base side of the blades and the insulator, wherein the core is formed by injecting a hard thermoplastic resin, and an outer skin is formed by injecting a soft thermoplastic resin, and wherein the core further comprises a generally flat coupling part extending from a front end of the covering parts toward a rear end of the covering parts.

2. The power cord of claim 1, wherein the core is positioned at a front side of the plug, and a front side of the core is exposed at the front side of the plug.

3. The power cord of claim 1, wherein a locking structure is formed between the core and the outer skin so as to prevent separation of the two by integrally forming the plug.

4. The power cord of claim 2, wherein the flat coupling part is of uniform thickness, and is provided to mutually couple the plural covering parts over a specified length range extending rearward of a front part of the core.

5. A method of manufacturing a power cord including covering a base side of blades and a leading end side of the power cord with synthetic resin thereby forming a plug, comprising:

a core forming process including placing the blades held in a specified interval spacing, and connected to plural conductors having an insulator positioned at the leading end side of the power cord, inside of a die, injecting a hard thermoplastic resin, from a base end of the blades to a leading end side of the power cord, into the die to form a core; and a plug forming process including placing the core inside of a die and injecting a soft thermoplastic resin into the die thereby forming the plug, wherein the method includes providing the core with covering parts corresponding to the number of plural conductors, the covering parts covering the base side of the blades and the insulator, wherein the method further providing the covering parts with a generally flat coupling part extending from a front end of the covering parts toward a rear end of the covering parts.

6. The method of manufacturing the power cord of claim 5, wherein the core is positioned at the front side of the plug, and the front side of the core is exposed to the front side of the plug in the plug forming process.

7. The method of manufacturing the power cord of claim 5, wherein a locking structure is formed between the core and outerskin so as to prevent separation of the two by integrally forming the plug in the plug forming process.

8. The method of manufacturing the power cord of claim 5, wherein the core is formed so as to be positioned in a thick portion at the front side of the plug in the plug forming process.

9. The method of manufacturing the power cord of claim 5, wherein the die used in the injecting and forming process divides the plug into two halves, and has parting lines formed at positions not dividing the blades.

10. The power cord of claim 1, wherein the coupling part includes bumps formed at a upper side and a lower side of the coupling part.

11. A method of manufacturing the power cord of claim 5, wherein the method includes providing the coupling part with bumps formed at an upper side and a lower side of the coupling part.

12. The power cord of claim 1, wherein the hard thermoplastic resin is selected from at least one of a polyamide, polybutadiene, or polypropylene, and the soft thermoplastic resin is a vinyl chloride.

13. The method of manufacturing the power cord of claim 5, wherein the hard thermoplastic resin is selected from at least one of a polyamide, polybutadiene, or polypropylene, and the soft thermoplastic resin is a vinyl chloride.

* * * * *